US007338349B2

(12) United States Patent
Yen

(10) Patent No.: US 7,338,349 B2
(45) Date of Patent: Mar. 4, 2008

(54) APPARATUS AND PROCESS FOR CYLINDRICALLY GRINDING WORKPIECES

(75) Inventor: Shih-Chieh Yen, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,743

(22) Filed: Sep. 21, 2006

(65) Prior Publication Data

US 2007/0161336 A1 Jul. 12, 2007

(30) Foreign Application Priority Data

Jan. 6, 2006 (CN) ..... 200610032809.8

(51) Int. Cl.
*B24B 1/00* (2006.01)
*B24B 41/06* (2006.01)

(52) U.S. Cl. ..... 451/28; 451/365

(58) Field of Classification Search ..... 451/364, 451/365, 384, 390, 49, 28, 57, 58, 42, 43, 451/44, 51, 278, 279
See application file for complete search history.

(56) References Cited

U.S. PATENT DOCUMENTS 1,847,577 A * 3/1932 Thompson ..... 76/104.1
2,056,491 A * 10/1936 Stimson ..... 451/365
2,623,336 A * 12/1952 Onksen, Jr. et al. ..... 451/365
7,144,306 B1 * 12/2006 Yen ..... 451/57

* cited by examiner

*Primary Examiner*—Robert A. Rose
(74) *Attorney, Agent, or Firm*—Jeffrey T. Knapp

(57) ABSTRACT

An apparatus for cylindrically grinding workpieces includes a first holding tool (100) for positioning pre-grinding workpieces (40) and a second holding tool (200) for positioning partially ground workpieces (i.e. workpieces which have been ground on one side only). The first holding tool (100) defines a first groove (226) for containing the pre-grinding workpieces to be partially ground and the second bonding defines a second groove (322) for containing the partially ground workpieces. At least one first resisting member (26) and at least one first back plate (24) detachably connect with the at least one first holding member (22), and thus making up the first holing tool (100). At least one second resisting member (36) and a at least one second back plate (34) detachably connect at least one second holding member (36), and thus making up the second holding tool (100). The present invention also provides a process for cylindrically grinding workpieces.

17 Claims, 8 Drawing Sheets

APPARATUS AND PROCESS FOR CYLINDRICALLY GRINDING WORKPIECES

FIELD OF THE INVENTION

The present invention generally relates to cylindrical grinding apparatuses and processes and, more particularly, to a holder for holding workpieces during a cylindrical grinding process and a holding method for such a process.

DESCRIPTION OF RELATED ART

Usually, optical elements such as camera lenses and spectacles are in used in cylindrical form. However, original optical workpieces (i.e. lens blanks) are most easily manufactured in the form of a square. Therefore, these original optical workpieces have to be cylindrically ground before use.

A typical example of a contemporary cylindrical grinding apparatus is a centering apparatus. The centering apparatus typically includes a pair of holders for holding the original workpiece, where each holder has a hollow chamber communicating with a surface of the holder. The holder can hold the workpiece on its surface by using an air pump evacuating the hollow chamber, and a grinding wheel is then used to cylindrically grind the workpiece. However, the centering apparatus can only cylindrically grind one workpiece at a time.

FIGS. 7-8 show an apparatus for cylindrically grinding more than one workpiece at a time. The apparatus includes a first holding tool 12 and a second holding tool 14. The first holding tool 12 defines a holding groove 122, and the second holding tool 14 defines a semicircular groove 142. The holding groove 122 and the semicircular groove 142 are both for securing the workpieces 16 in the holding tools 12, 14. In use, firstly, a plurality of workpieces 16 are placed in the holding groove 122 of the first holding tool 12. Secondly, the workpieces 16 are bonded together using an adhesive. Thirdly, a grinding wheel is used to grind a portion of the workpieces 16 projecting out of the holding groove 122 into a semicircular shape. Fourthly, the semicircular portion 162 of the workpieces 16 is transferred to the semicircular groove 142 of the second holding tool 14. Fifthly, the other portion of the workpieces 16 is also ground into a semicircular shape using the grinding wheel. The final result being that the workpieces 16 are ground to a cylindrical shape.

When transferring the workpieces 16 from the first holding tool 12 to the second holding tool 14, the adhesive should be dissolved so that the workpieces 16 can be taken out of the first holding tool 12. However, the workpieces 16 will not be held compactly in the second holding tool 14 and may become disarrayed whilst the adhesive is being dissolved.

Therefore, an apparatus and a process for cylindrically grinding workpieces which can easily and compactly transfer the workpieces is desired.

SUMMARY OF THE INVENTION

In one aspect, an apparatus for cylindrically grinding workpieces includes a first holding tool for positioning pre-grinding workpieces and a second holding tool for positioning partially ground workpieces (i.e. workpieces which have been ground on one side only). The first holding tool defines a first groove for containing the pre-grinding workpieces to be partially ground and the second bonding defines a second groove for containing the partially ground workpieces. A first resisting member and a first back plate detachably connect with at least one first holding member, and thus making up the first holding tool. A second resisting member and a second back plate detachably connect at least one second holding member, and thus make up the second holing tool.

In another aspect, a process for grinding workpieces can be used wherein a plurality of pre-grinding workpieces are positioned in a first groove of a first holding tool with a first portion of the pre-grinding workpieces projecting out of the first groove. The first portion of the pre-grinding workpieces is partially ground into a first predetermined shape. A second holding tool is provided, the second holding tool defining a second groove. The first holding tool is detached, whilst the second holding tool is then placed on the partially ground workpieces with the first portion in the second groove. The parts of the second holding tool are fastened. The second holding tool is then reversed, whilst a second portion of the workpieces projects out of the second groove, this second portion is then ground into a second predetermined shape thus completing the grinding process.

Other advantages and novel features will become more apparent from the following detailed description when taken in conjunction with the accompanying drawings.

BRIEF DESCRIPTION OF THE DRAWINGS

Many aspects of the apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
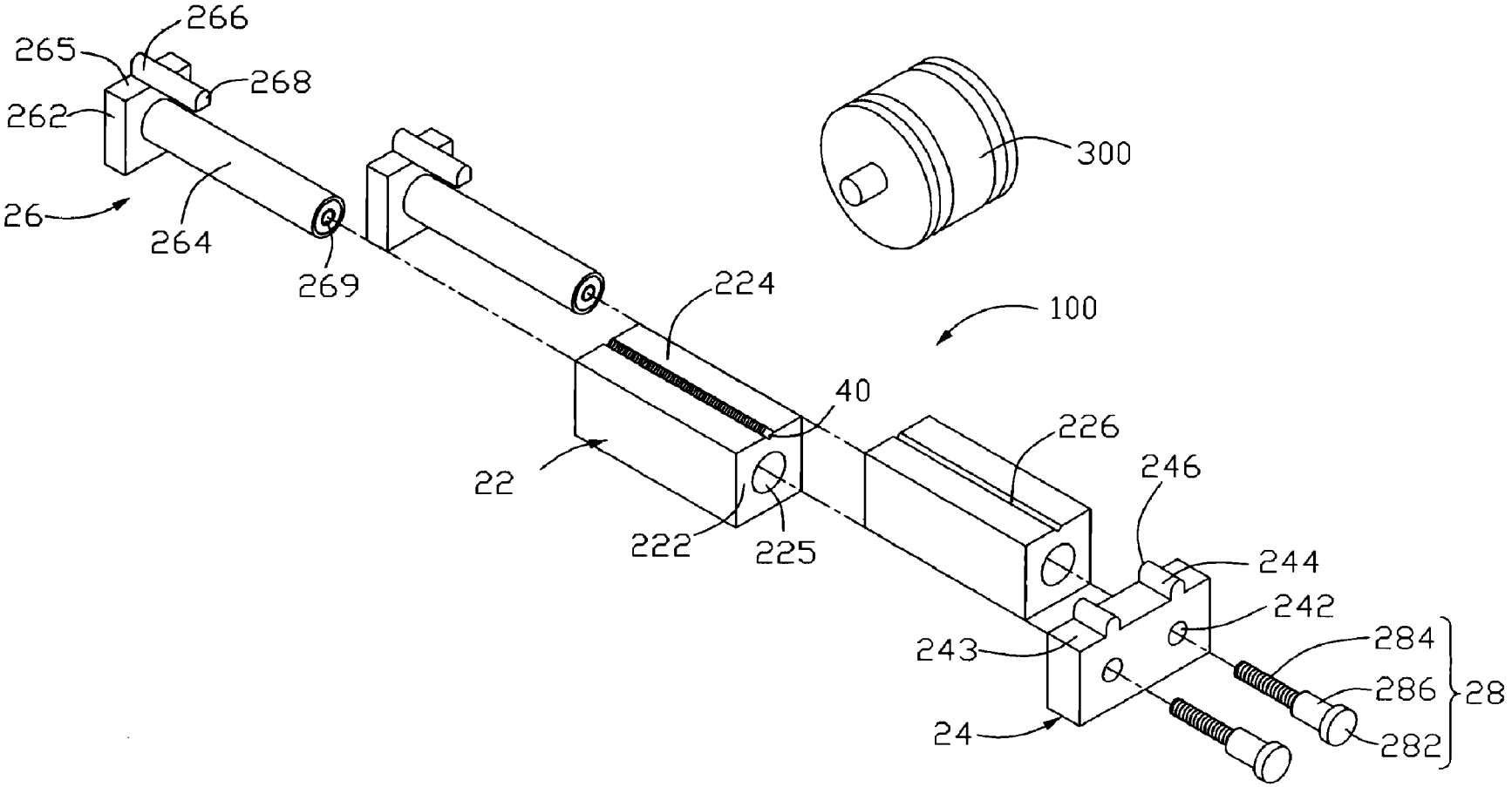
FIG. 1 is a schematic view of a first holding tool of an apparatus for cylindrically grinding workpieces in accordance with a first preferred embodiment.
Figure 2:
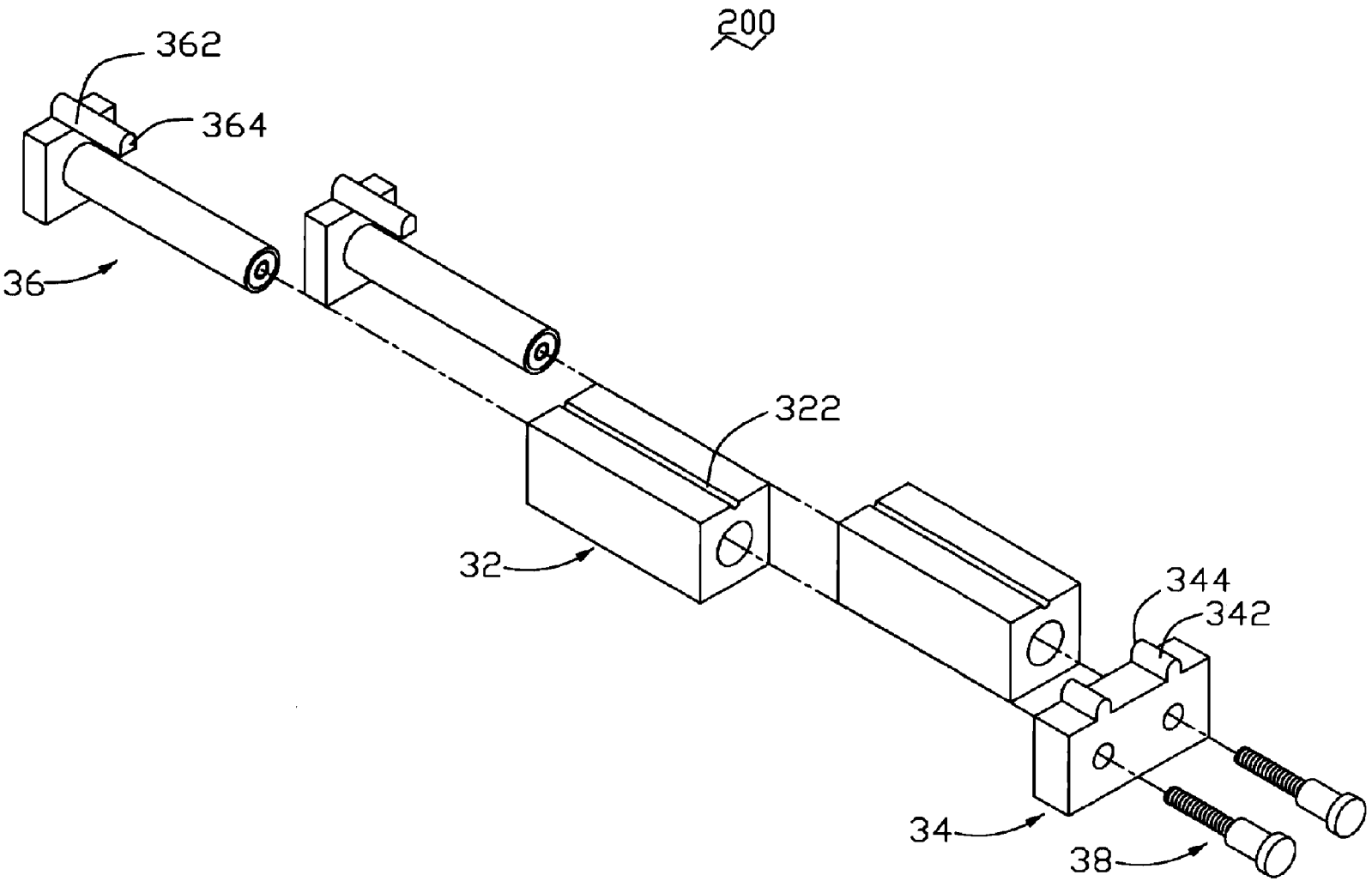
FIG. 2 is a schematic view of a second holding tool of the apparatus for cylindrically grinding workpieces in accordance with the first preferred embodiment.

Referring to FIGS. 1-2, an apparatus for cylindrically grinding workpieces 40 according to a first preferred embodiment, includes a first holding tool 100, a second holding tool 200, and a grinding wheel 300. The holding tools 100, 200 are configured for holding workpieces 40.

The first holding tool 100 includes two first holding members 22, a first back plate 24, two first resisting members 26, and two first fixing members 28.

Each first holding member 22 is rectangular in shape, and has two opposite side surfaces 222, and a working surface 224 between the side surfaces 222. Each first holding member 22 defines a through-hole 225 extending through the side surfaces 222. The working surface 224 defines a first groove 226 for containing pre-grinding workpieces 40. The pre-grinding workpieces 40 can be optical elements having a non-cylindrical shape. In this preferred embodiment, the workpieces 40 are substantially square-shaped. Therefore, the first groove 226 is configured to have a V-shaped cross section along a traverse direction, for compliantly receiving the pre-grinding workpieces 40 therein. The pre-grinding workpieces 40 are partially ground on the first groove 226 and centers of the workpieces 40 are higher than the working surface 224, thus the grinding wheel 300 cannot touch the working surface 224 when the grinding wheel 300 grinds the workpieces 40. Understandably, the cross section along a traverse direction of the first groove 226 may be of other shape depending on the shape of the pre-grinding workpieces 40.

The first back plate 24, which is substantially rectangular shaped, defines two spaced bores 242. The bores 242 correspond to the through-holes 225 of the first holding members 22. The first back plate 24 has a top surface 243 paralleling the axes of the bores 242. Two protruding columns 244 are formed on the top surface 243. A cross-section along a traverse direction of the protruding column 244 is semicircular shape, and a radius of the protruding column is same as that of the finished product, corresponding to the shape of the first groove 226. Each protruding column 244 has an end surface 246 which is used to resist the workpieces 40. The end surface 246 is flat enough to avoid harming the workpieces 40.

The first resisting members 26 include a base plate 262, and a column 264 extending from one surface of the base plate 262. A diameter and a length of the column 264 are similar to those of the through-hole 225 of the first holding member 22. A screw hole 269 is defined at the end of the column 264. The screw hole 269 is coaxial to the column 264. The cross section shape along a traverse direction of protruding column 266 is the same as the protruding column 244 of the first back plate 24. The extension direction of the protruding column 266 is the same as that of the column 264. Each protruding column 266 has a end surface 268 which is used to resist the workpieces 40.

The fixing member 28, includes a head portion 282, a screw portion 284, and a connecting portion 286. The connecting portion 286 connects the head portion 282 and the screw portion 284. A diameter of the head portion 282 is larger than that of the connecting portion 286, thus the diameter of the connecting portion 286 is larger than that of the screw portion 284.

The configuration of the second holding tool 200 is almost the same as that of the first holding tool 100. The second holding tool 200 includes two second holding members 32, a second back plate 34, two second resisting members 36, and two second fixing members 38. The back plate 34 includes two protruding columns 342 having an end surface 344. Each resisting member 36 includes a protruding column 362 having an end surface 364. Compared with the first holding tool 100, the second holding tool 200 has some differences, which are as follows: each holding member 32 defines a second groove 322 having a semicircular shaped cross section along a traverse direction; A radius of the second groove 322 is same as the finished product.

In assembling the first holding tool 100, the first holding members 22 are joined together with the first grooves 226 facing upward. The protruding columns 266 face upward, and each column 264 is inserted through the through-holes 225. The first back plate 24 abuts against the side surfaces 222 of the first holding members 22. Finally, each first fixing member 28 is inserted through the bores 242 and the screw portion 284 is screwed into the screw holes 269 of the columns 264.

The process of assembling the second holding tool 200 is the same as that of the first holding tool 100.

Figure 3:
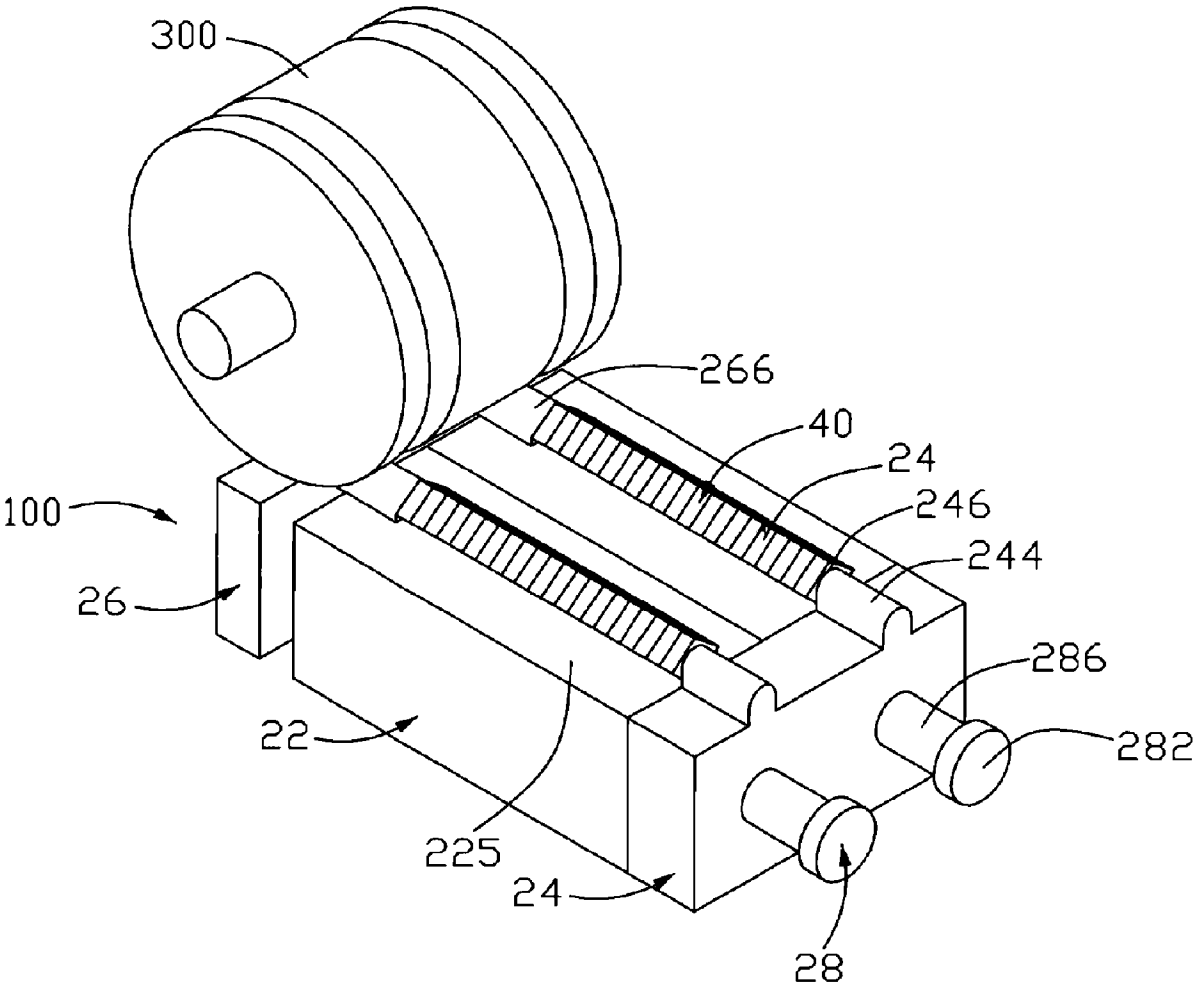
FIG. 3 is a schematic view of a step of the process for cylindrically grinding workpieces using the apparatus of FIG. 1.
Figure 4:
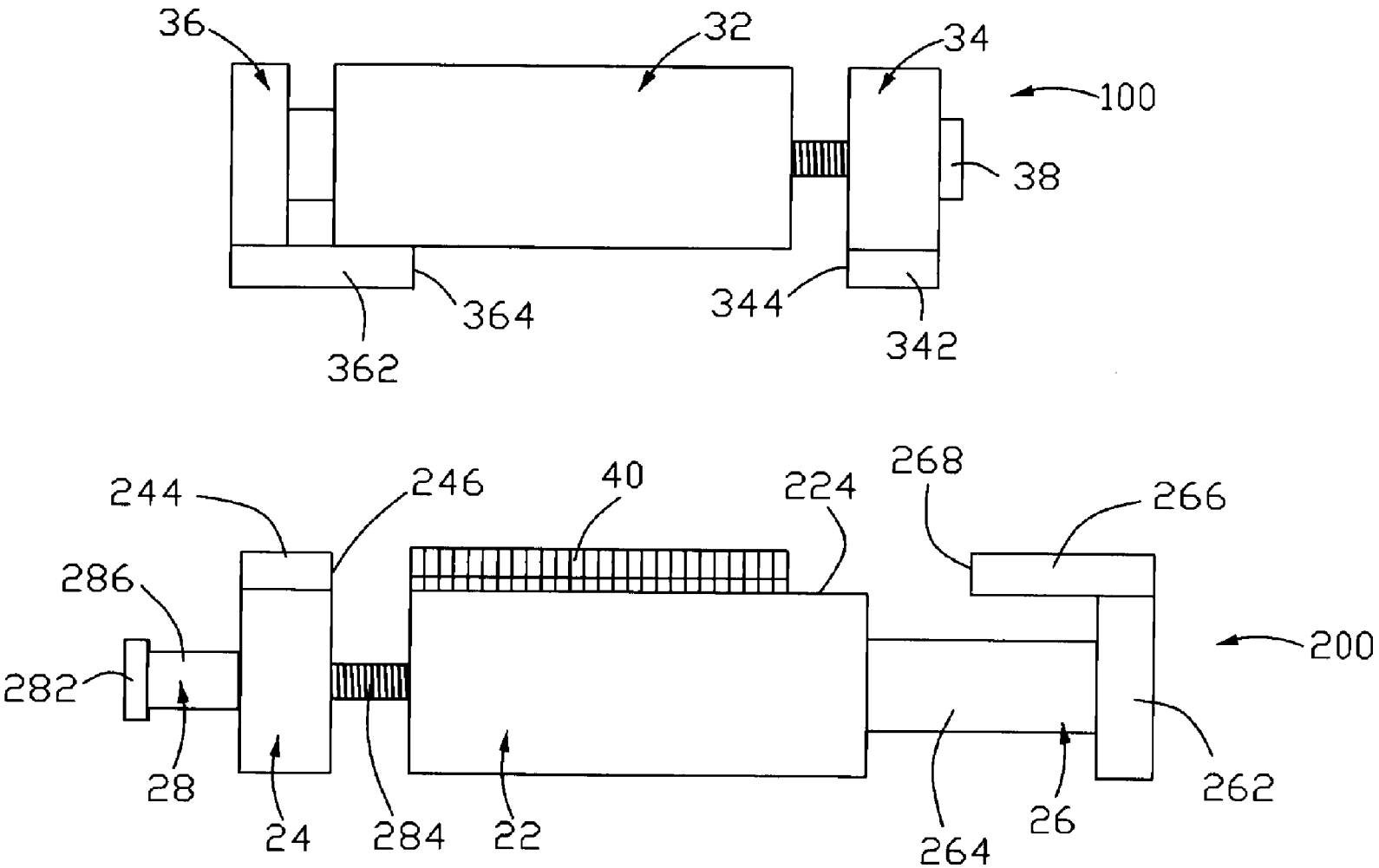
FIG. 4 is a schematic view of another step subsequent to the step in FIG. 3.
Figure 5:
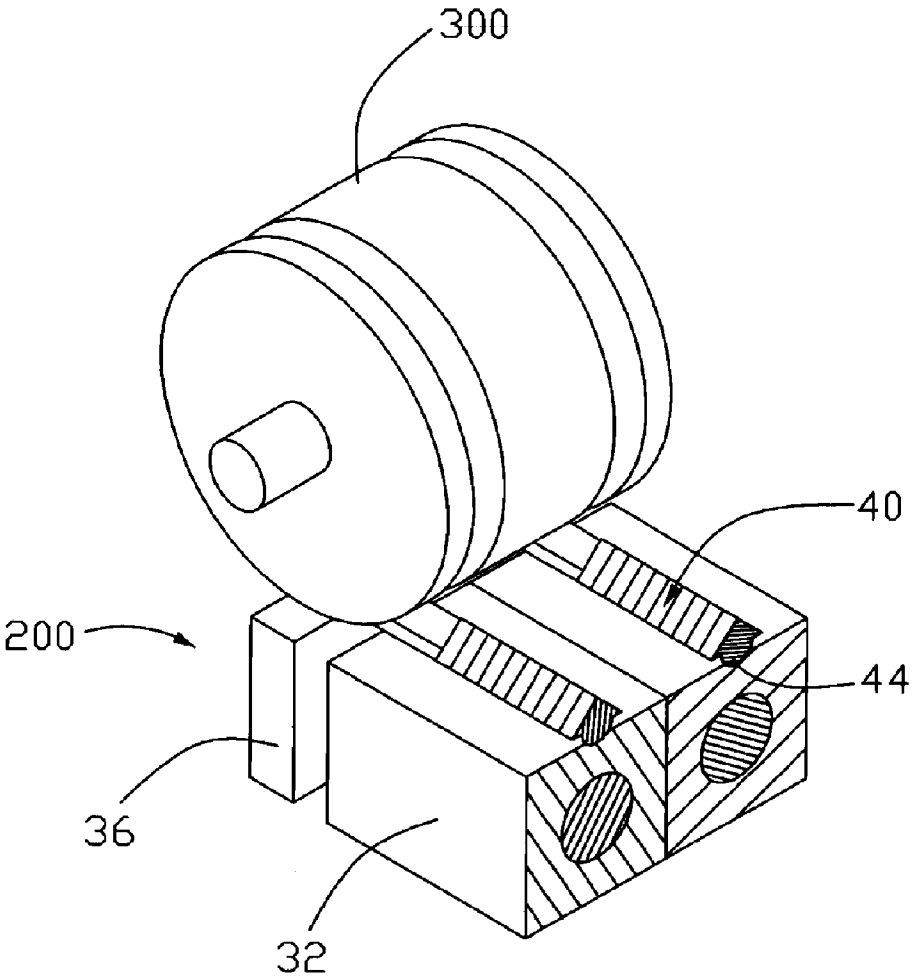
FIG. 5 is a schematic view of a further step subsequent to the step in FIG. 4.

Referring to FIGS. 3-5, an exemplary process for cylindrically grinding workpieces 40 includes the steps of:

(1) A stack of workpieces 40 (i.e. pre-grinding workpieces) are placed in the first groove 226 of the first holding tool 100. The first fixing members 28 are screwed down and the pre-grinding workpieces 40 are clamped by the protruding columns 244, 266. A first portion 42 of the pre-grinding workpieces 40 projects out of the first grooves 226.

(2) The first portion 42 of the pre-grinding workpieces 40 is partially ground to a semicircular shape.

(3) The first fixing members 28 of the first holding tool 100 are released so that the first back plate 24 and the first resisting members 26 are detached from the first holding tool 100. The second holding tool 200 is placed on the partially ground workpieces 40 with the first portion 41 in the second groove 322. The second fixing members 38 are screwed down and the partially ground workpieces 40 are clamped.

(4) The holding tool 200 is reversed and a second portion 44 of the partially ground workpieces 40 projects out of the second grooves 322.

(5) The second portion 42 of the workpieces 40 is ground to a semicircular shape. Thus a plurality of cylindrical workpieces 40 are obtained.

It is believed that the cross section along a traverse direction of the first grooves 226 can be of other shape, for example, a square groove can be defined under the original first groove 226. The first grooves 226 and the second grooves 322 may extend to the end surfaces of the holding members 22, 32.

It is believed that the number of the holding members 22, 32 can be changed and the number of the corresponding resisting members 26, 36 can be changed accordingly; the first resisting members 26 of the first holding tool 100 can be integrally formed and the second resisting members 36 of the second holding tool 200 can also be integrally formed.

The process can easily and compactly transfer workpieces 40 from the first grooves 226 to the second groove 322 using the resisting members 26, 36 and the back plate 24, 34 which can promote the working efficiency of the cylindrical process. Also the process does not use adhesive, and thus does not require water or other solvents to dissolve the adhesive, so the workpieces 40 can avoid becoming disarrayed.

Figure 6:
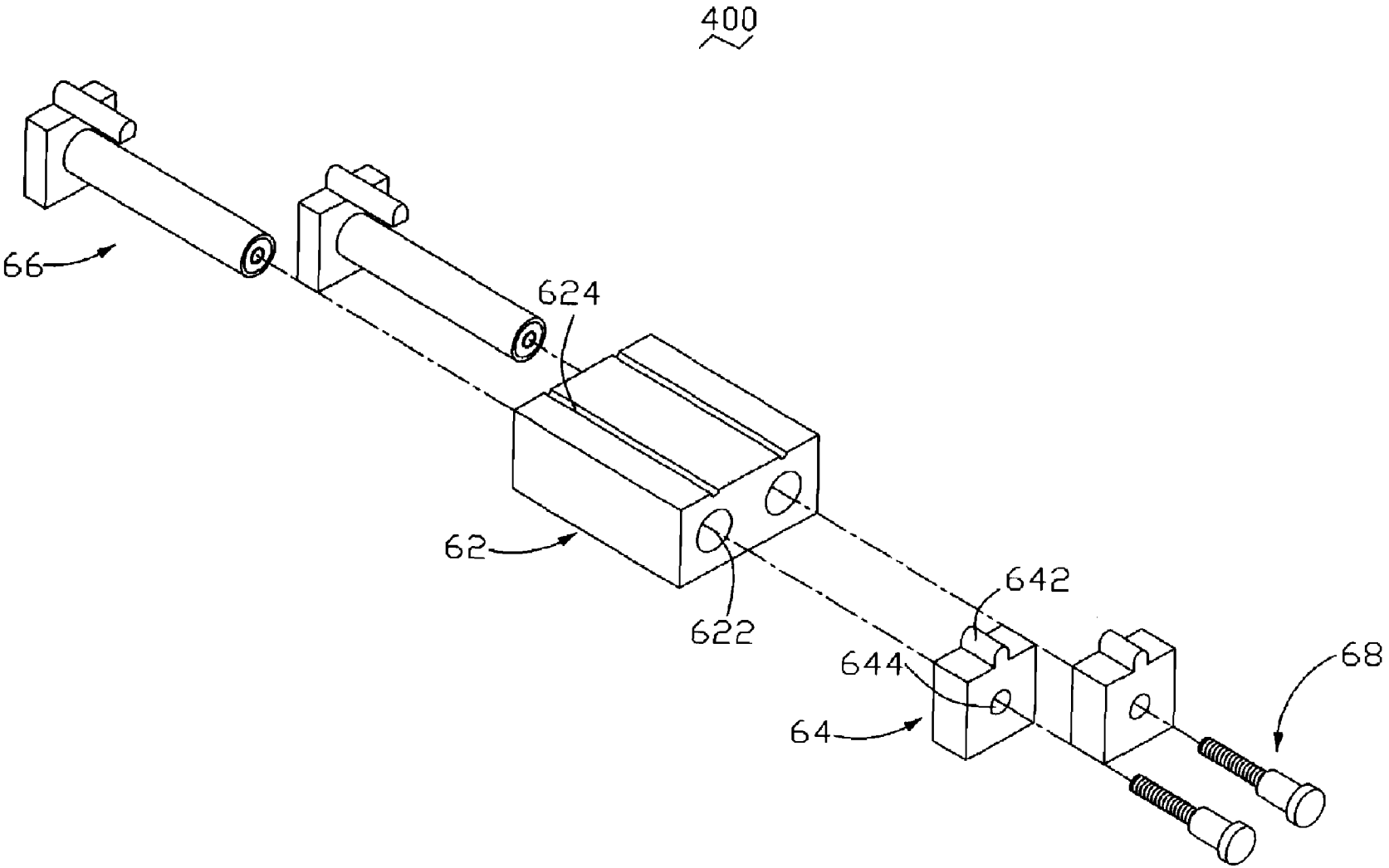
FIG. 6 is a schematic view of a first holding tool of an apparatus for cylindrically grinding workpieces in accordance with a second preferred embodiment.
Figure 7:
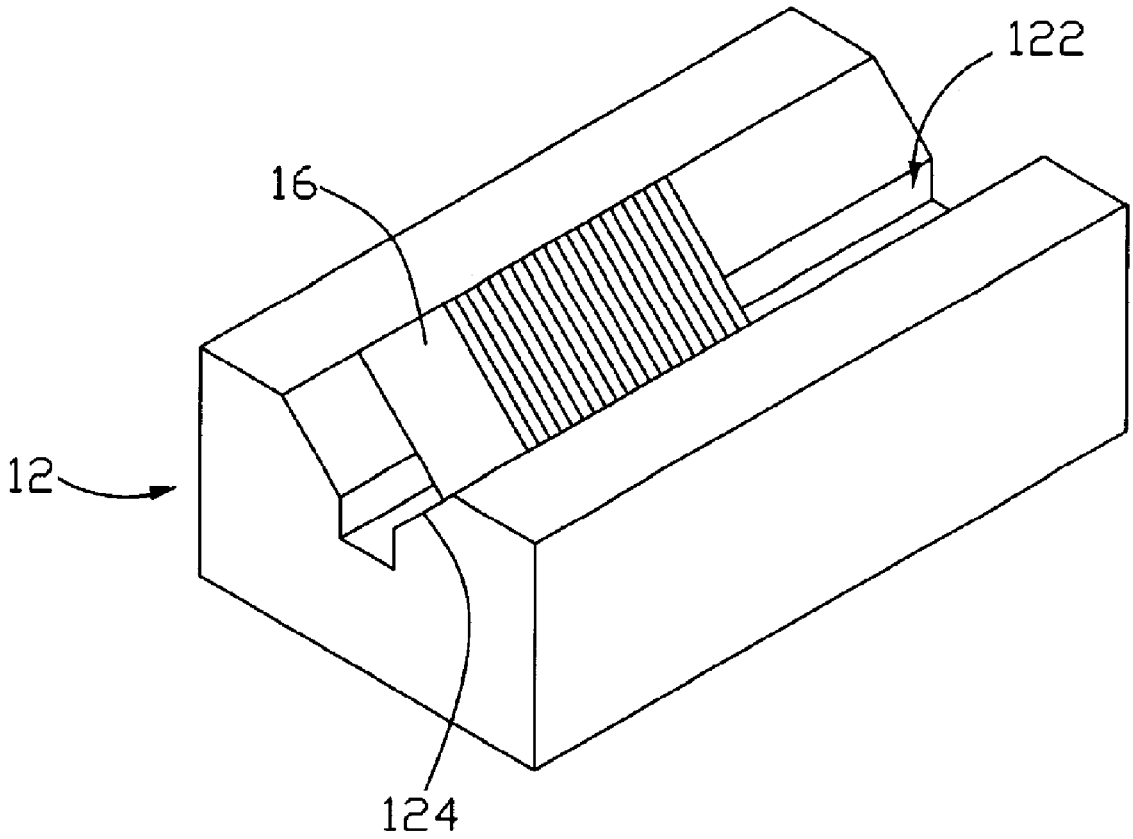
FIG. 7 (RELATED ART)
FIG. 7 is a schematic view of a first holding tool of a typical apparatus for cylindrically grinding workpieces.
Figure 8:
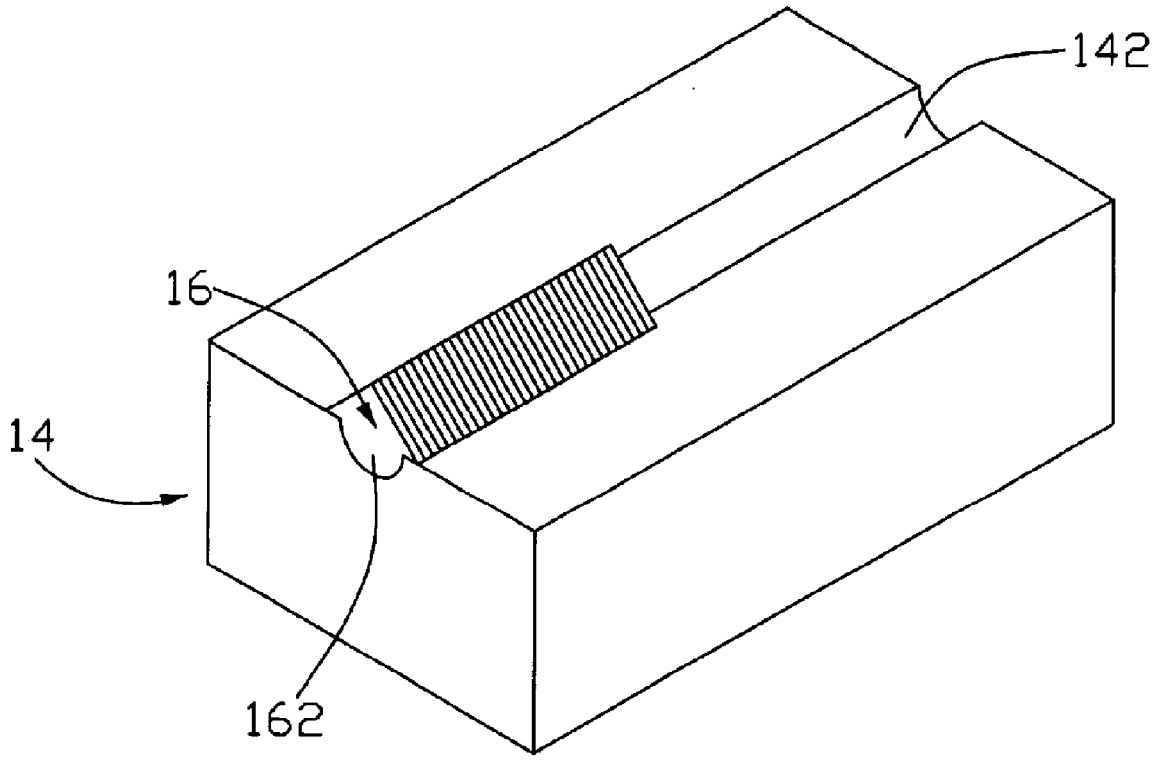
FIG. 8 (RELATED ART)
FIG. 8 is a schematic view of a second holding tool of the apparatus in FIG. 7.

Referring to FIG. 6, an apparatus for cylindrically grinding workpieces according to a second preferred embodiment includes a first holding tool 100 and a second holding tool 200. The first holding tool 100 includes one holding member 62, two back plates 64, two resisting members 66, and two fixing members 68. The holding member 62 defines two through-holes 622 and two grooves 624 with a V-shaped cross section along a traverse direction. Each back plate 64 defines a bore. The second holding tool is same as the first holding tool 100 except for the cross section shape along a traverse direction of the grooves 624 being semicircular.

It is believed that the present embodiments and their advantages will be understood from the foregoing description, and it will be apparent that various changes may be made thereto without departing from the spirit and scope of the invention or sacrificing all of its material advantages, the examples here before described merely being preferred or exemplary embodiments of the invention.

What is claimed is:

1. An apparatus for cylindrically grinding workpieces, comprising:

a first holding tool for positioning pre-grinding workpieces, the first holding tool including at least one first holding member, at least one first resisting member, and at least one first back plate, the at least one first holding member defining at least one first groove configured for containing the pre-grinding workpieces to be partially ground, the first resisting member and the first back plate being detachably connected to two opposite sides of the at least one first holding member for resisting the pre-grinding workpieces; and a second holding tool for positioning partially ground workpieces, the second holding tool including at least one second holding member, at least one second resisting member, and at least one second back plate, the second holding member defining at least one second groove for containing the partially ground workpieces, the second resisting member and the second back plate detachably being connected to two opposite sides of the second holding member for resisting the partially ground workpieces;

wherein the first holding tool has a first mating surface with the first groove defined therein, the second holding tool has a second mating surface with the second groove defined therein, the first groove aligns with the second groove when the first mating surface mates with the second mating surface, the at least one first groove and the at least one second groove respectively have a first groove shape and a second groove shape different from the first groove shape, the first groove shape of the at least one first groove is thereby configured for receiving the pre-grinding workpieces, and the second groove shape of the at least one second groove is thereby configured for receiving the partially ground workpieces.

2. The apparatus as claimed in claim 1, wherein the at least one first groove has a V-shaped cross section along a traverse direction.

3. The apparatus as claimed in claim 1, wherein the at least one second groove has a semicircular shaped cross section along a traverse direction.

4. The apparatus as claimed in claim 1, wherein the first holding tool has at least one first fixing member, the first fixing member includes a head portion, a connecting portion, and a screw portion, the connecting portion joins the head portion and the screw portion, the at least one first resisting member has a column which defines a screw hole, the screw hole matches the screw potion, the at least one first back plate defines a bore, the bore matches the connecting portion.

5. The apparatus as claimed in claim 1, wherein the second holding tool has at least one second fixing member, the second fixing member includes a head portion, a connecting portion, and a screw portion, the connecting portion joins the head portion and the screw portion, the at least one second resisting member has a column which defines a screw hole, the screw hole matches the screw potion, the at least one second back plate defines a bore, the bore matches the connecting portion.

6. The apparatus as claimed in claim 1, wherein the at least one first resisting member includes a base plate, a column, and a protruding column, the column and the protruding column both extend from the base plate, the at least one first holding member defines a through-hole which matches the column.

7. The apparatus as claimed in claim 6, wherein the column defines a screw hole, the at least one first holding tool has at least one first fixing member, the at least one first fixing member includes a screw portion, the screw portion matches the screw hole.

8. The apparatus as claimed in claim 1, wherein the at least one second resisting member includes a base plate, a column, and a protruding column, the column and the protruding column both extend from the base plate, the at least one second holding member defines a through-hole configured to receive the column.

9. The apparatus as claimed in claim 8, wherein the column defines a screw hole, the at least one second holding tool has at least one second fixing member, the second fixing member includes a screw portion, the screw portion matches the screw hole.

10. The apparatus as claimed in claim 1, wherein the number of the at least one first holding member is two, the number of the at least one first resisting member is two, each resisting member includes a base plate, a column, and a protruding column, the column and the protruding column both extend from the base plate.

11. The apparatus as claimed in claim 10, wherein the apparatus further comprises two first fixing members, each fixing member includes a head portion, a screw portion, and a connecting portion, the connecting portion joins the head portion and the screw portion, each column defines a screw hole configured for receiving the screw portion of the first fixing member, the back plate defines two bores configured for receiving the connecting portions of the first fixing member.

12. The apparatus as claimed in claim 1, wherein the number of the at least one second holding member is two, the number of the at least one second resisting member is two, each resisting member includes a base plate, a column, and a protruding column, the column and the protruding column both extend from the base plate.

13. The apparatus as claimed in claim 12, wherein the apparatus further comprises two second fixing members, each fixing member includes a head portion, a screw portion, and a connecting portion, the connecting portion joins the head portion and the screw portion, each column defines a screw hole configured for receiving the screw portion of the second fixing member, the back plate defines two bores configured for receiving the connecting portions of the second fixing member.

14. A process for grinding workpieces, comprising the steps of:

providing a first holding tool, the first holding tool having at least one first holding member, at least one first resisting member, and at least one first back plate, the at least one first holding member defining at least one first groove, the at least one first resisting member and the at least one first back plate detachably connecting with the at least one first holding member;

positioning a plurality of pre-grinding workpieces in the at least one first groove of the first holding tool, with a first portion of the pre-grinding workpieces projecting out of the first groove;

fastening the at least one first resisting member and the at least one first back plate with the at least one first holding member, the pre-grinding workpieces being resisted by the at least one first resisting member and the at least one first back plate;

partially grinding the first portion of the pre-grinding workpieces to a first predetermined shape;

providing a second holding tool, the second holding tool including at least one second holding member, at least one second resisting member, and at least one second back plate, the at least one second holding member defining at least one second groove, the at least one second resisting member and the at least one second back plate detachably connecting to the at least one second holding member;

detaching the at least one first resisting member and the at least one first back plate from the at least one first holding member;

placing the second holding tool on the partially ground workpieces, with the first portion in the at least one second groove;

fastening the at least one second resisting member and the at least one second back plate with the at least one second holding member, reversing the second holding tool, with a second portion of the partially ground workpieces projecting out of the at least one second groove;

grinding the second portion of the workpieces to a second predetermined shape.

15. The process as claimed in claim 14, wherein the workpieces are ground using a grinding wheel.

16. The process as claimed in claim 14, wherein the first and second predetermined shapes are each semicircular in shape.

17. The apparatus as claimed in claim 1, wherein the resisting members and back plates are detached from a corresponding holding member before the first mating surface mates with the second mating surface, and the second resisting member and the second back plate are firmly fastened to the holding member when respective half portions of the partially ground workpieces are received in the second groove.

* * * * *